US006178721B1

(12) United States Patent
Turfan

(10) Patent No.: US 6,178,721 B1
(45) Date of Patent: Jan. 30, 2001

(54) APPARATUS AND METHOD FOR PLACING CORNER PROTECTORS OF DIFFERENT HEIGHTS ON PALLETIZED

(75) Inventor: Faruk M. Turfan, Quebec (CA)

(73) Assignee: Illinois Tool Works Inc., Glenview, IL (US)

( * ) Notice: Under 35 U.S.C. 154(b), the term of this patent shall be extended for 0 days.

(21) Appl. No.: 09/262,117

(22) Filed: Mar. 4, 1999

(51) Int. Cl.[7] ..... B65B 61/00

(52) U.S. Cl. ..... 53/410; 53/64; 53/139.7; 53/168

(58) Field of Search ..... 53/64, 66, 139.6, 53/139.7, 168, 201, 410

(56) References Cited

U.S. PATENT DOCUMENTS

| | | | | |
|---|---|---|---|---|
| 2,714,792 | | 8/1955 | Wright et al. . | |
| 2,937,484 | | 5/1960 | Wiman . | |
| 3,026,659 | | 3/1962 | Harrison . | |
| 3,241,287 | * | 3/1966 | Chundelak | 53/139.7 X |
| 3,271,925 | * | 9/1966 | Aubery | 53/139.6 |
| 3,378,987 | | 4/1968 | Lems . | |
| 3,585,780 | * | 6/1971 | Elmore | 53/139.7 X |
| 3,953,020 | | 4/1976 | Ruf et al. . | |
| 4,587,791 | * | 5/1986 | Brouse et al. | 53/139.6 |
| 4,587,796 | | 5/1986 | Haloila . | |
| 4,700,530 | * | 10/1987 | Norberg | 53/139.7 X |
| 4,897,980 | | 2/1990 | Geyser et al. . | |
| 4,930,292 | | 6/1990 | Focke et al. . | |
| 4,947,605 | | 8/1990 | Ramsey . | |
| 4,949,533 | | 8/1990 | Bate . | |
| 5,044,499 | | 9/1991 | Marion . | |
| 5,226,280 | | 7/1993 | Scherer et al. . | |
| 5,289,668 | * | 3/1994 | Meyer | 53/139.7 X |
| 5,423,118 | * | 6/1995 | Lotti | 53/139.7 X |
| 5,535,572 | | 7/1996 | Morantz et al. . | |
| 5,546,730 | * | 8/1996 | Newell et al. | 53/139.7 X |
| 5,564,254 | * | 10/1996 | Thimon et al. | 53/139.7 X |
| 5,596,863 | * | 1/1997 | Kasel | 53/139.7 X |

FOREIGN PATENT DOCUMENTS 853775 4/1987 (FI) .

OTHER PUBLICATIONS

Cornerboard/Stretch Wrap System, Newway Packaging Machinery.

* cited by examiner

*Primary Examiner*—Daniel B. Moon
(74) *Attorney, Agent, or Firm*—Schwartz & Weinrieb

(57) ABSTRACT

Apparatus and method for placing corner protectors upon corner regions of loads or articles to be wrapped, banded, or otherwise packaged comprises a plurality of corner protector magazines and operatively associated corner protector pick-up arm and transfer assemblies which are divided into two groups of diagonally opposed magazines and pick-up arm and transfer assemblies wherein the two groups of magazines respectively house corner protectors having two different height dimensions. Depending upon the sensed height dimensions of the loads or articles, one of the two groups of magazines and pick-up arm and transfer assemblies are selectively activated so as to place the proper dimensioned corner protectors upon corner regions of the loads or articles.

22 Claims, 2 Drawing Sheets

APPARATUS AND METHOD FOR PLACING CORNER PROTECTORS OF DIFFERENT HEIGHTS ON PALLETIZED

FIELD OF THE INVENTION

The present invention relates generally to apparatus and a method for wrapping, banding, or otherwise packaging palletized loads or articles, and more particularly to apparatus and a method for placing corner protectors upon the corner regions of loads or articles prior co the wrapping, banding, or otherwise packaging thereof.

BACKGROUND OF THE INVENTION

Apparatus for wrapping, banding, or otherwise packaging loads or articles generally comprises a framework defining a wrapping, banding, or packaging station for receiving the articles or load to wrapped, banded, or packaged, and a rotating and vertically reciprocable wrapping, banding, or packaging material dispensing unit supported upon the framework for rotation about the articles or load so as to wrap, band, or package the same. The load or articles to be wrapped, banded, or otherwise packaged usually comprise opposed pairs of vertical sides wherein adjacent sides meet at an angle so as to define a vertically extending corner therebetween. The load or articles also usually have an upper horizontally disposed surface which includes a plurality of horizontally disposed upper edges extending between the upper ends of the vertically extending corners. Prior to wrapping, banding, or otherwise packaging the load or articles, it is often desirable to apply corner protectors to the corner regions of the load or articles, and to apply a top or cap protector to the top region of the load or articles in order to protect the vertically extending corner and upper edge regions of the load or articles from being crushed by the wrapping or packaging film, or the strapping or banding, or from being crushed or otherwise damaged during transportation, shipping, or storage of the wrapped, packaged, or strapped or banded load or articles.

The corner protectors are generally made from paper or paperboard material which are pre-folded so as to define a pair of panels which meet at an angle and have interior surfaces which form interior corners for correspondingly mating with the exterior corners of the load or articles to be wrapped, banded, or otherwise packaged. The apparatus for applying a corner protector onto the load or articles generally comprises, for each corner region of the load or articles, a magazine for storing a plurality or supply of the corner protectors, and a pick-up or transfer mechanism operatively associated with the magazine for removing a corner protector from the magazine and transferring the corner protector to the particular or corresponding corner of the load or articles. One such type of apparatus which has heretofore been proposed, and which is currently well-known in the industry, is that disclosed within the U.S. Pat. No. 5,535,572, the complete disclosure of which is hereby incorporated herein by reference. As noted more particularly within the aforenoted U.S. Pat. No. 5,535,572, once the corner protectors are mounted upon or disposed adjacent to or in abutment with the external corner regions of the load or articles to be wrapped, banded, or otherwise packaged, wrapping, packaging, or banding of the load or articles is then initiated, and while the initial stage of the wrapping, packaging, or banding of the load or articles is being accomplished, the corner protector pick-up or transfer mechanisms are withdrawn and readied for a subsequent operational cycle whereby the next set of corner protectors will be applied to external corner regions of a different load or set of articles to be wrapped, banded, or otherwise packaged.

While the apparatus disclosed within the aforenoted U.S. Pat. No. 5,535,572 has been quite satisfactory from an operational viewpoint, and has been quite commercially successful, it is of course readily noted that such apparatus is operationally programmed or configured in effect to simultaneously apply corner protectors upon all four corners of a palletized load or set of articles to be wrapped, banded, or otherwise packaged, wherein the corner protectors being applied to the load or articles to be wrapped, banded, or otherwise packaged necessarily comprise substantially the same length or height dimension corresponding of course to the height dimension of the load or set of articles to be wrapped, banded, or otherwise packaged. Consequently, should different sets of articles or loads, to be wrapped, banded, or otherwise packaged, comprise different length or height dimensions, the apparatus disclosed within the aforenoted U.S. Pat. No. 5,535,572 would not be able to readily accommodate the wrapping, banding, or packaging needs attendant such loads or articles having such differing height or length dimensions due to the fact that the corner protectors have predetermined length dimensions which would obviously correspond to, for example, a first set of the loads or articles to be wrapped, banded, or otherwise packaged, and would not properly correspond to a second set of the loads or articles having height or length dimensions which are different from the first set of loads or articles and the corner protectors corresponding thereto.

Under the foregoing circumstances, the manufacturing or packaging facility would have to necessarily institute alternative or optional modes of operation in order to be capable of utilizing the wrapping, banding, or packaging apparatus disclosed within the aforenoted U.S. Pat. No. 5,535,572. More particularly, one optional mode of operation would be to pre-sort the loads or articles, to be wrapped, banded, or otherwise packaged, into groups of loads or articles having substantially the same length or height dimensions whereby all of the groups of loads or articles having a first common length or height dimension would be conveyed to the wrapping, banding, or packaging station so as to wrapped, banded, or otherwise packaged, and subsequently, all of the groups of loads or articles having a second common length or height dimension would then be conveyed to the wrapping, banding, or packaging station so as to be appropriately wrapped, banded, or otherwise packaged. Such a mode of operation, however, is not particularly desirable from the viewpoint that the same is time-consuming and inefficient in that the loads or articles to be wrapped, banded, or otherwise packaged must necessarily be pre-sorted and cannot be processed, that is, wrapped, banded, or packaged, in an essentially random manner according, for example, to the timed order in which customer requests or orders are received. A correlated mode of operation might constitute the routing of such pre-sorted loads or articles along two different processing paths leading to separate or different wrapping, banding, or packaging stations and associated equipment which can handle such loads or articles having such different length or height dimensions, however, such a mode of operation obviously entails significantly increased equipment costs, layout space, and the like.

A third mode of operation might constitute the routing of the loads or articles, having the different height or length dimensions, along the single conveyor path to the single wrapping, banding, or packaging station and associated equipment, in a random manner and without any pre-sorting of the articles or loads into groups having a common length or height dimension, and the subsequent wrapping, banding, or packaging of the same. However, when loads or articles having different length or height dimensions are introduced, positioned, or located at the wrapping, banding, or packaging station, the wrapping, banding, or packaging equipment or apparatus would have to necessarily be shut down for a predetermined period of time in order to permit operator personnel to load the corner protector magazines with the appropriately dimensioned corner protectors, and in addition, the equipment may have to be, in effect, re-programmed such that the corner protectors are disposed at proper elevational positions with respect to the loads or articles to be wrapped, banded, or otherwise packaged. Obviously, such a mode of operation would be highly labor-intensive and operationally inefficient.

A need therefore exists in the art for a new and improved apparatus, and a method of operating the same, wherein loads or articles to be wrapped, banded, or otherwise packaged, and having different length or height dimensions, can be conveyed to a single wrapping, banding, or packaging station in a random manner and nevertheless be wrapped, banded, or packaged in a continuous flow-through process without the system necessarily being, in effect, temporarily shut down so as to install or exchange corner protectors of the proper or appropriate size, within the corner protector magazines, corresponding to the particular load or article, to be wrapped, banded, or packaged, currently disposed or located at the wrapping, banding, or packaging station.

OBJECTS OF THE INVENTION

Accordingly, it is an object of the present invention to provide new and improved apparatus, and a method of operating the same, for placing corner protectors of different height or length dimensions upon palletized loads or articles to be wrapped, banded, or otherwise packaged.

Another object of the present invention is to provide new and improved apparatus, and a method of operating the same, for placing corner protectors of different height or length dimensions upon palletized loads or articles to be wrapped, banded, or otherwise packaged, which effectively overcomes the operative disadvantages or drawbacks characteristic of the known prior art systems.

A further object of the present invention is to provide new and improved apparatus, and a method of operating the same, for placing corner protectors having different height or length dimensions upon palletized loads or articles to be wrapped, banded, or otherwise packaged, wherein loads or articles to be wrapped, banded, or otherwise packaged, and having different length or height dimensions, can be conveyed to a single wrapping, banding, or packaging station in a random manner and nevertheless be wrapped, banded, or otherwise packaged in a continuous flow-through process without the system necessarily being, in effect, temporarily shut down so as to install or exchange corner protectors of the proper or appropriate size, within the corner protector magazines, corresponding to the particular load or article, to be wrapped, banded, or otherwise packaged, which is currently disposed or located at the wrapping, banding, or packaging station.

SUMMARY OF THE INVENTION

The foregoing and other objectives are achieved in accordance with the teachings of the present invention through the provision of a new and improved apparatus, and a method of operating the same, wherein two different sets of corner protector magazines and two different sets of operatively associated pick-up arm and transfer mechanisms are provided. All of the corner protector magazines and operatively associated pickup arm and transfer mechanisms are located or disposed at locations which are adjacent to a single wrapping, banding, or packaging station to which loads or articles, having different length or height dimensions, are randomly conveyed.

Each set of corner protector magazines and operatively associated pick-up arm and transfer mechanisms comprises a pair of corner protector magazines and operatively associated pick-up arm and transfer mechanisms respectively disposed within the vicinity of opposite corner regions of the wrapping, banding, or packaging station so as to be disposed adjacent to or within the vicinity of oppositely located corner regions of the load or articles being wrapped, banded, or otherwise packaged. Each one of the corner protector magazines comprising one of the corner protector magazines disposed within the first set or pair of corner protector magazines is provided with corner protectors having a first length or height dimension, and each one of the corner protector magazines comprising one of the corner protector magazines disposed within the second set or pair of corner protector magazines is provided with corner protectors having a second length or height dimension which is different from the first length or height dimension characteristic of the corner protectors disposed within the first set or pair of corner protector magazines.

The load or articles to be wrapped, banded, or otherwise packaged are conveyed to the wrapping, banding, or packaging station by means of, for example, a suitable infeed roller conveyor, and the wrapping, banding, or packaging station comprises a turntable upon which the load or articles to be wrapped, banded, or otherwise packaged, are disposed during the wrapping, banding, or packaging operation. A suitable sensor mechanism, such as, for example, a photodetector or the like, is operatively associated with the infeed conveyor so as to sense the length or height dimension of the load or articles, currently being conveyed by the infeed conveyor to the wrapping, banding, or packaging station, as being one of two different height or length dimensions which would be characteristic of the load or articles being wrapped, banded, or otherwise packaged.

A signal, indicative of a first one of the height or length dimensions characteristic of the load or articles being conveyed to the wrapping, banding, or packaging station, is then generated by the sensor mechanism and conveyed, for example, to a central processor which is then able to be selectively activate a particular one of the sets of corner protector magazines and operatively associated pick-up arm and transfer mechanisms, in dependence upon, correlation with, or corresponding to the sensed or detected length or height dimension of the particular load or articles being conveyed to the single wrapping, banding, or packaging station, whereby corner protectors are mounted upon a pair of opposite corners of the load or articles being wrapped, banded, or otherwise packaged. Subsequently, the turntable is rotated 90°, and those corners of the load or articles, being wrapped, banded, or otherwise packaged, and which do not as yet have corner protectors mounted thereon, are now disposed adjacent to the same set of corner protector magazines and pick-up arm and transfer mechanisms which were previously activated. These same magazines and pick-up arm and transfer mechanisms are then again activated and corner protectors are now mounted upon the remaining corners of the load or articles to be wrapped, banded, or otherwise packaged. Wrapping, banding, or packaging of the load or articles is then completed, and the turntable is then rotated 90°, back to its original position whereupon the wrapped, banded, or packaged load or article is then discharged from the wrapping, banding, or packaging station by means of a suitable outfeed conveyor.

It is to be understood that if the sensor mechanism detects the height or length dimension of the particular load or articles, to be wrapped, banded, or otherwise packaged, and being conveyed to the wrapping, banding, or packaging station by the infeed conveyor, to have a length or height dimension which is different from the noted first one of the height or length dimensions, then the second set of corner protector magazines and pick-up arm and transfer mechanisms are activated so as to mount corner protectors, having a second one of the height or length dimensions, upon the load or articles to be wrapped, banded, or otherwise packaged. In this manner, load or articles having differing length or height dimensions can be conveyed to the wrapping, banding, or packaging station in a random manner, and the wrapping, banding, or packaging thereof can be achieved in a relatively continuous mode without requiring any temporary interruption or shut-down of the apparatus or equipment in order to provide the system with the proper or appropriately sized corner protectors.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
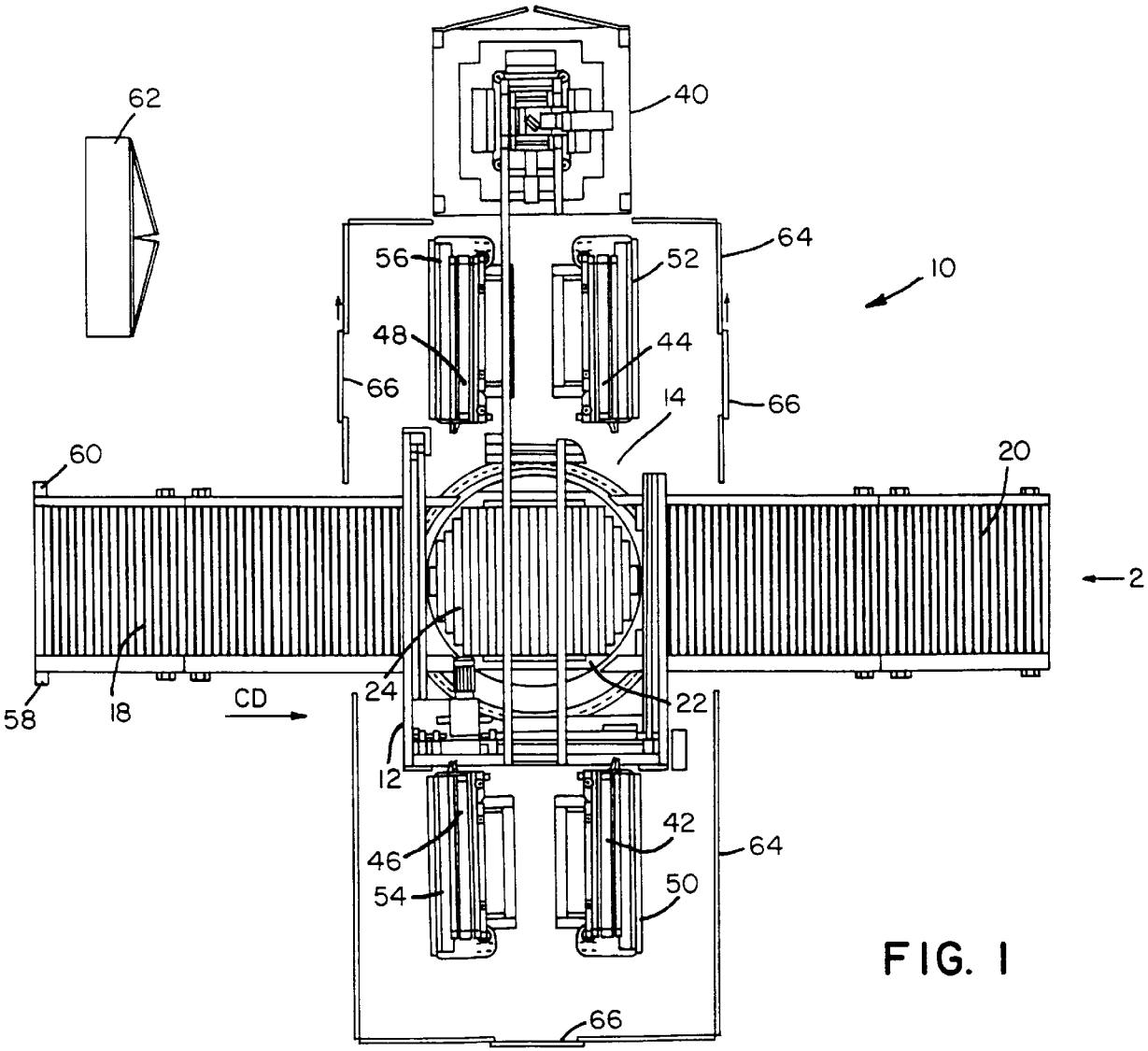
FIG. 1 is a top plan view of the new and improved corner protector and pick-up arm and transfer apparatus, for applying or mounting corner protectors upon palletized loads or articles to be wrapped, banded, or otherwise packaged, constructed in accordance with the principles and teachings of the present invention and showing the cooperative parts thereof.
Figure 2:
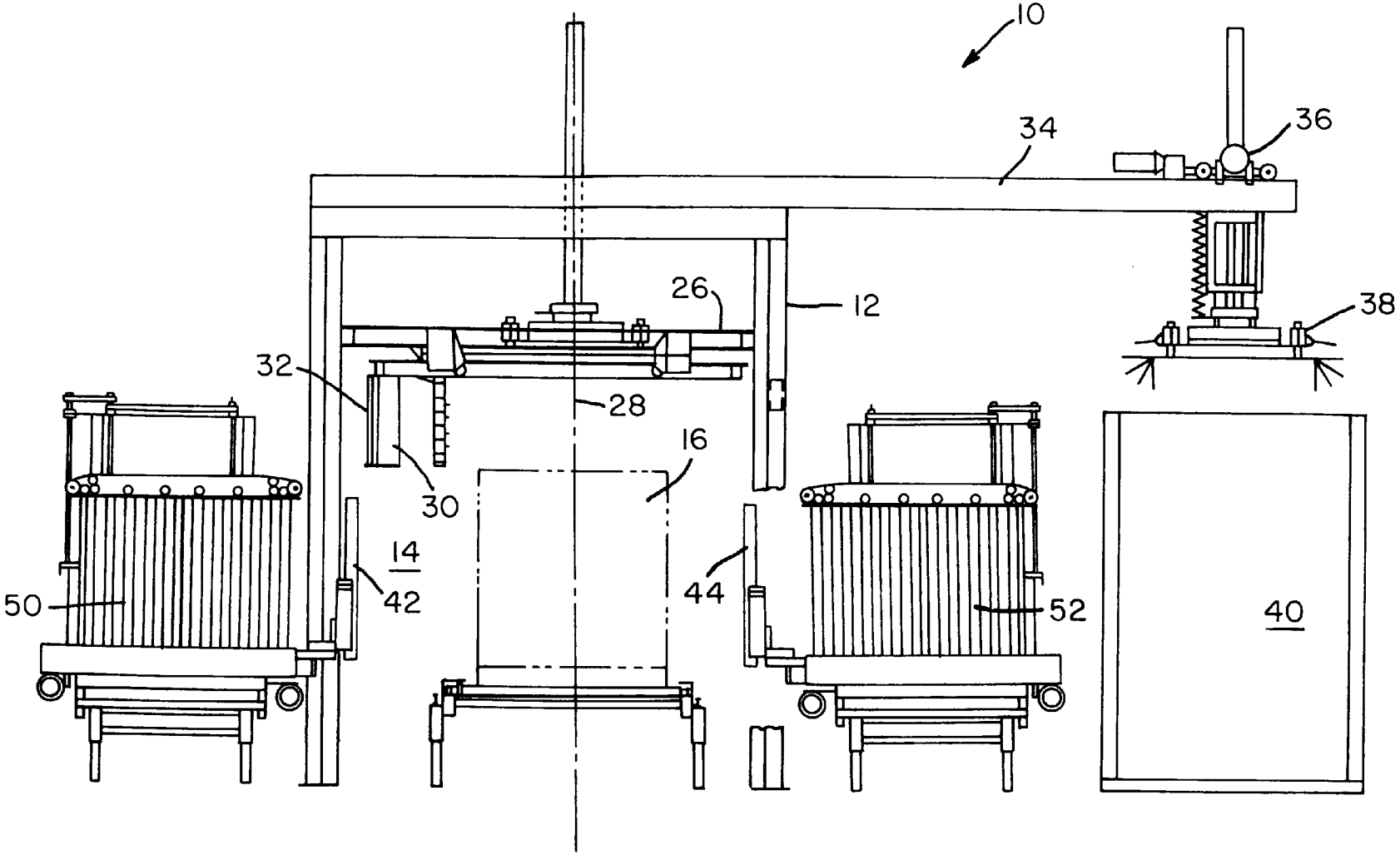
FIG. 2 is a right side view of the new and improved corner protector and pick-up arm and transfer apparatus disclosed in FIG. 1 as viewed in the direction of arrow 2 shown in FIG. 1.

Referring now to the drawings, and more particularly to FIGS. 1 and 2 thereof, the new and improved corner protector and pick-up arm and transfer apparatus, for applying or mounting corner protectors upon palletized loads or articles to be wrapped, banded, or otherwise packaged, is disclosed and is generally indicated by the reference character 10. It is initially noted that the general or overall apparatus or system 10 of the present invention is substantially similar to the general or overall apparatus or system disclosed within the aforenoted U.S. Pat. No. 5,535,572, the disclosure of which is again hereby noted as being incorporated herein by reference, except as will be specifically noted in connection with the additions, changes, alterations, and improvements which constitute the present invention as when compared with the general or overall system of U.S. Pat. 5,535,572.

It is noted further, for example, that FIG. 2 of the present patent application is quite similar to FIG. 1 of U.S. Pat. No. 5,535,572, and consequently, in light of the foregoing statements and facts, a detailed description of the various known components of the overall apparatus or system will not be described herein, and such components will only be generally or briefly referred to, noted, and described in order to provide basic comprehension and appreciation of the apparatus or system of the present invention. For greater or more in-depth detail of such components, and the operations thereof, referral may be made to U.S. Pat. No. 5,535,572, the detailed description of the present patent application being appropriately dedicated to the required description of the new and improved, novel components, and the operations thereof, of the apparatus and system comprising the present invention.

As best seen in FIG. 2, the apparatus or system 10 of the present invention comprises a stationary framework or assembly 12 within the center of which there is defined a load or article wrapping, banding, or packaging station 14 at which a load or article 16 is disposed so as to be wrapped, banded, or otherwise packaged. As best seen in FIG. 1, the load or article 16 to be wrapped, banded, or packaged is conveyed into the wrapping, banding, or packaging station 14 by means of a suitable infeed roller conveyor 18, and the wrapped, banded, or packaged load or article 16 is discharged from the wrapping, banding, or packaging station 14 by means of a suitable outfeed roller conveyor 20, the conveying direction being from left to right as seen in FIG. 1 and is denoted by the arrow CD. The wrapping, banding, or packaging station 14 is provided with a turntable 22, the purpose of which will be described hereinafter, and the turntable 22 is also provided with roller conveyor elements 24.

With reference again being made specifically to FIG. 2, the stationary framework or assembly 12 has mounted thereon a vertically reciprocable ring frame assembly 26 which is also rotatable about a vertical axis 28. A roll of wrapping or packaging film 30 is mounted upon a wrapping film carriage 32 which, in turn, is mounted upon the ring frame assembly 26 so as to be rotatable therewith about the axis 28 and thereby be capable of, for example, wrapping a suitable plastic film wrapping material around the load 16 during the performance of a wrapping or packaging operation as the plastic film wrapping material is withdrawn or discharged from the roll of wrapping or packaging film material 30. The stationary framework or assembly 12 further comprises an upper beam member or rail system 34 upon which is movably supported another carriage or shuttle mechanism 36. The latter carriage or shuttle mechanism 36, in turn, supports a dependent top cap protector folding assembly 38 which serially removes top cap protectors from a top cap protector magazine 40 and serves to apply such top cap protectors to the upper ends of the loads or articles 16 being wrapped, banded, or packaged so as to protect the upper edge portions of the wrapped, banded, or packaged loads or articles 16.

With reference now being made again to both FIGS. 1 and 2, the new and improved operative components constructed in accordance with the principles and teachings of the present invention, and characteristic of the present invention as comprising the improvements in the art, will now be described. More particularly, the apparatus or system 10 further comprises a plurality of corner protector pick-up arm and transfer assemblies 42,44,46,48 which are respectively operatively associated with corner protector magazines 50,52,54,56, wherein the corner protector pick-up arm and transfer assemblies 42–48 and the corner protector magazines 50–56 are arranged in a substantially rectangular array upon opposite sides of the wrapping, banding, or packaging station 14 and the turntable 22 thereof as best seen in FIG.

1. Unlike the corner protector pick-up arm and transfer assemblies, and the corner protector magazines, of the aforenoted U.S. Pat. No. 5,535,572, wherein all of the corner protector magazines of such patented system housed corner protectors of substantially the same length or height dimensions which were accordingly serially picked up and transferred to particular corner locations upon a particular palletized load or set of articles being wrapped, banded, or otherwise packaged, the corner protector magazines 50–56 of the present invention are adapted to house corner protectors having substantially two different length or height dimensions, and the pick-up arm and transfer mechanisms or assemblies 42–48 operatively associated with such magazines 50–56, respectively, are adapted to deliver, transport, or transfer such different length or dimensioned corner protectors to specific corner regions of the load or articles being wrapped, banded, or otherwise packaged when selectively activated.

More specifically, in accordance with the operative teachings and principles of the present invention, the corner protector pick-up arm and transfer assemblies 42–48, and the corner protector magazines 50–56 operatively associated therewith, are effectively divided or separated into two groups or sets of diagonally opposed corner protector pick-up arm and transfer assemblies and corner protector magazines. For example, diagonally opposed corner protector pick-up arm and transfer assemblies 42 and 48, and corresponding corner protector magazines 50 and 56, comprise a first set or group of corner protector pick-up arm and transfer assemblies, and corner protector magazines, wherein corner protector magazines 50 and 56 house corner protectors having a first predetermined length or height dimension, and diagonally opposed corner protector pickup arm and transfer assemblies 44 and 46, and corresponding corner protector magazines 52 and 54, comprise a second set or group of corner protector pick-up arm and transfer assemblies, and corner protector magazines, wherein corner protector magazines 52 and 54 house corner protectors having a second predetermined length or height dimension. The corner protector pickup arm and transfer assemblies, and the associated corner protector magazines within a particular one of the sets or groups of corner protector pick-up arm and transfer assemblies, and corner protector magazines, will be selectively activated in unison at a particular time in order to mount corner protectors upon particular corner regions of the palletized load or articles to be wrapped, banded, or otherwise packaged, while the corner protector pick-up arm and transfer assemblies, and the corner protector magazines, of the other set or group of corner protector pick-up arm and transfer assemblies, and the corner protector magazines, remain idle as will become more apparent from the description disclosed hereinafter.

In order to determine which set or group of corner protector pick-up arm and transfer assemblies, and corner protector magazines, are to be activated, a suitable sensing system is used to determine the height of the load or stack of articles disposed upon the infeed conveyor 18 and transported thereby to the wrapping, banding, or packaging station 14. The sensing system may be, for example, a photodetection system comprising a phototransmitter 58 and a photoreceiver 60 disposed, for exmaple, upon opposite sides of the infeed conveyor 18, although such phototransmitter and photoreceiver may alternatively be located at a position upstream from that disclosed in connection with infeed conveyor 18, such as, for example, at a position at which the load or stack of articles is actually assembled. In any case, the photoreceiver 60 is electronically connected to a central processor 62, and processor 62 is, in turn, electronically connected to the corner protector pick-up arm and transfer assemblies 42–48 as well as to the corner protector magazines 50–56 so as to selectively activate the same. It can thus be appreciated that when photoreceiver 60 detects a load or stack of articles which have a first predetermined height or length dimension, then a first signal is generated thereby and transmitted to the central processor 62 whereupon, in turn, a corresponding first signal is generated by processor 62 so as to simultaneously activate corner protector pick-up arm and transfer assemblies 42 and 48, and corner protector magazines 50 and 56, while corner protector pick-up arm and transfer assemblies 44 and 46, and corner protector magazines 52 and 54, remain idle. Alternatively, when photoreceiver 60 detects a load or stack of articles which have a second predetermined height or length dimension, then a second signal is generated thereby and transmitted to the central processor 62 whereupon, in turn, a corresponding second signal is generated by processor 62 so as to simultaneously activate corner protector pick-up arm and transfer assemblies 44 and 46, and corner protector magazines 52 and 54, while corner protector pickup arm and transfer assemblies 42 and 48, and corner protector magazines 50 and 56, remain idle.

A brief description of a complete operative wrapping, banding, or packaging cycle will now be described. A first load or set of stacked articles is conveyed upon infeed conveyor 18 and passes photodetector elements 58,60 whereby the length or height dimension of such first load or set of stacked articles is detected. The first load or set of stacked articles is then conveyed onto the rollers of the turntable 22 located at the center of the wrapping, banding, or packaging station 14, and as a result of the detection of the length or height dimension of the first load or set of stacked articles, diagonally opposed corner protector pick-up arm and transfer assemblies 42 and 48, as well as the corresponding corner protector magazines 50 and 56, are actiavted. Accordingly, a pair of corner protectors are picked up and withdrawn from the corner protector magazines 50 and 56 by means of the corner protector pick-up arm and transfer assemblies 42 and 48, and the pair of corner protectors are then moved into position upon the two diagonally opposite corner regions of the load or stack of articles.

The rotatable ring frame assembly 26, having the roll of wrapping film 30 mounted thereon, is then activated, and a first wrapping layer of wrapping film is disposed around the upper end of the load or stacked articles so as to retain the two corner protectors upon the two diagonally opposed corner regions of the load or stacked articles. The pick-up arm and transfer assemblies 42 and 48 are then retracted or withdrawn from their positions immediately adjacent to the load or stacked articles, and the turntable 22 is then rotated 90° such that the two remaining corners of the load or stacked articles, not yet having corner protectors mounted thereon, are now disposed within the vicinity of the same previously activated corner protector pick-up arm and transfer assemblies 42 and 48, as well as corner protector magazines 50 and 56. The corner protector pick-up arm and transfer assemblies 42 and 48 are again activated in conjunction with the corner protector magazines 50 and 56 whereby a second pair of corner protectors are withdrawn from the magazines 50 and 56 and mounted upon the two corner regions of the load or stacked articles which did not previously have corner protectors mounted thereon. The rotatable ring frame assembly 26 is again activated so as to wrap another layer of wrapping material around the load or stacked articles whereby the second set of two corner protectors are now secured upon the load or stacked articles. The pick-up arm and transfer assemblies 42 and 48 are then again retracted and withdrawn, and the wrapping, banding, or packaging of the load or stacked articles is then completed. After completion of the wrapping, banding, or packaging of the load or stacked articles, the turntable 22 is again rotated 90° back to its original position, and the wrapped, banded, or packaged load or set of stacked articles is then discharged from the turntable 22 onto the outfeed conveyor 20.

If the next load or stack of articles to be wrapped, banded, or otherwise packaged has a similar height or length dimension as that of the first load or stack of articles, then the wrapping, banding, or packaging cycle or operation as described above is repeated. However, if a subsequent load or stack of articles to be wrapped, banded, or packaged has a length or height dimension which is different from that of the first load or stack of articles as noted above, then such different height or length dimension is detected by means of the photodetector elements 58,60, and accordingly, the other set or group of corner protector pick-up arm and transfer assemblies 44 and 46, as well as corner protector magazines 52 and 54, are activated so as to correspondingly perform a wrapping, banding, or packaging operation similar to that described in connection with corner protector pick-up arm and transfer assemblies 42 and 48, as well as corner protector magazines 50 and 56.

It is lastly noted that in order to minimize any danger to operator personnel from the operations of the corner protector pick-up arm and transfer assemblies 42–48, as well as the operations of the corner protectors magazines 50–56, such structures are enclosed within suitable wall or fence structure 64. However, such structure 64 is also provided with a plurality of access doors 66 so as to provide ingress and egress for maintenance personnel as may be necessary.

Thus, it may be seen that in accordance with the principles and teachings of the present invention, new and improved apparatus, and a method of operating the same, has been developed whereby different loads or articles, having different height or length dimensions, may be conveyed to a wrapping, banding, or packaging station in a random manner, and corner protectors of different length or height dimensions, corresponding to the particular height or length dimensions of the particular loads or articles, may nevertheless be applied to the loads or articles in a substantially continuous, flow-through process or manner without interruption or temporary shutdown of the wrapping, banding, or packaging operation or system which would otherwise be necessary in order to exchange the supply of corner protectors within the corner protector magazines so as to in fact provide corner protectors of an appropriate size.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Apparatus for placing corner protectors upon corner regions of a load to be wrapped, comprising:

wrapping station means for supporting loads to be wrapped;

a plurality of corner protector magazines divided into two groups of corner protector magazines and housing corner protectors having two different height dimensions for placement upon corner regions of loads supported upon said wrapping station means; and a plurality of corner protector pick-up arm and transfer assembly means divided into two groups of corner protector pick-up arm and transfer assembly means and respectively operatively associated with said two groups of said corner protector magazines for picking up and transferring corner protectors having a first height dimension by a first one of said two groups of said corner protector pick-up arm and transfer assembly means from a first one of said two groups of said corner protector magazines so as to place said corner protectors, having said first height dimension, upon corner regions of a first load supported upon said wrapping station means and requiring corner protectors having said first height dimension, while a second one of said two groups of said corner protector pick-up arm and transfer assembly means, operatively associated with a second one of said two groups of said corner protector magazines housing corner protectors having a second height dimension, remain idle, and for picking up and transferring corner protectors having a second height dimension by said second one of said two groups of said corner protector pick-up arm and transfer assembly means from said second one of said two groups of said corner protector magazines so as to place said corner protectors, having said second height dimension, upon corner regions of a second load supported upon said wrapping station means and requiring corner protectors having said second height dimension, while said first one of said two groups of said corner protector pick-up arm and transfer assembly means, operatively associated with said first one of said two groups of said corner protector magazines housing corner protectors having said first height dimension, remain idle.

2. The apparatus as set forth in claim 1, wherein:

said plurality of corner protector magazines, and said plurality of corner protector pick-up arm and transfer assembly means respectively operatively associated with said plurality of corner protector magazines, are disposed in a substantially rectangular array around said wrapping station means.

3. The apparatus as set forth in claim 2, wherein:

said plurality of corner protector magazines, and said plurality of corner protector pick-up arm and transfer assembly means respectively operatively associated with said plurality of corner protector magazines, disposed in said substantially rectangular array comprise four corner protector magazines and four corner protector pick-up arm and transfer assemblies for disposition adjacent to the corner regions of the loads supported upon said wrapping station means.

4. The apparatus as set forth in claim 3, wherein:

said two groups of said four corner protector magazines comprises a first group of two corner protector magazines diagonally opposed with respect to each other at first and second corners within said substantially rectangular array, and a second group of two corner protector magazines diagonally opposed with respect to each other at third and fourth corners within said substantially rectangular array; and said two groups of said four corner protector pick-up arm and transfer assemblies comprises a first group of two corner protector pick-up arm and transfer assemblies diagonally opposed with respect to each other at said first and second corners within said substantially rectangular array, and a second group of two corner protector pick-up arm and transfer assemblies diagonally opposed with respect to each other at said third and fourth corners within said substantially rectangular array.

5. The apparatus as set forth in claim 4, further comprising:

sensor means for determining the height dimension of the load to be wrapped at said wrapping station means, and for generating a signal indicative of the sensed height dimension of the load to be wrapped at said wrapping station means; and means for receiving said sensor signal and for selectively activating a single one of said first and second groups of said corner protector magazines and a single one of said first and second groups of said corner protector pick-up arm and transfer assemblies such that appropriately sized corner protectors are deposited upon corner regions of the loads.

6. The apparatus as set forth in claim 5, further comprising:

turntable means disposed at said wrapping station means for positioning the load between a first angular position at which two corner protectors are mounted upon two corners of the load by said single one of said first and second groups of said corner protector pick-up arm and transfer assemblies, and a second angular position, displaced 900 from said first angular position, at which two additional corner protectors are mounted upon two other corners of the load by said single one of said first and second groups of said corner protector pick-up arm and transfer assemblies.

7. The apparatus as set forth in claim 5, further comprising:

infeed and outfeed conveyor means for conveying a load to be wrapped toward said wrapping station means, and for conveying a wrapped load away from said wrapping station means.

8. The apparatus as set forth in claim 7, wherein:

said sensor means comprises photodetector means disposed upon opposite sides of said infeed conveyor means.

9. Apparatus for placing corner protectors upon corner regions of a load to be wrapped, comprising:

a single wrapping station for supporting loads to be wrapped;

a plurality of corner protector magazines divided into two groups of corner protector magazines and housing corner protectors having two different height dimensions for placement upon corner regions of loads supported upon said single wrapping station; and a plurality of corner protector pick-up arm and transfer assembly means divided into two groups of corner protector pick-up arm and transfer assembly means and respectively operatively associated with said two groups of said corner protector magazines for picking up and transferring corner protectors, having a first height dimension, by a first one of said two groups of said corner protector pick-up arm and transfer assembly means from a first one of said two groups of said corner protector magazines so as to place said corner protectors, having said first height dimension, upon corner regions of a first load supported upon said single wrapping station and requiring corner protectors having said first height dimension, while a second one of said two groups of said corner protector pick-up arm and transfer assembly means, operatively associated with a second one of said two groups of said corner protector magazines housing corner protectors having a second height dimension, remains idle, and for picking up and transferring corner protectors, having a second height dimension, by said second one of said two groups of said corner protector pick-up arm and transfer assembly means from said second one of said two groups of said corner protector magazines so as to place said corner protectors, having said second height dimension, upon corner regions of a second load supported upon said single wrapping station and requiring corner protectors having said second height dimension, while said first one of said two groups of said corner protector pick-up arm and transfer assembly means, operatively associated with said first one of said two groups of said corner protector magazines housing corner protectors having said first height dimension, remains idle.

10. The apparatus as set forth in claim 9, wherein:

said plurality of corner protector magazines, and said plurality of corner protector pick-up arm and transfer assembly means respectively operatively associated with said plurality of corner protector magazines, are disposed in a substantially rectangular array around said single wrapping station.

11. The apparatus as set forth in claim 10, wherein:

said plurality of corner protector magazines, and said plurality of corner protector pick-up arm and transfer assembly means respectively operatively associated with said plurality of corner protector magazines, disposed in said substantially rectangular array comprise four corner protector magazines and four corner protector pick-up arm and transfer assemblies for disposition adjacent to the corner regions of the loads supported upon said single wrapping station.

12. The apparatus as set forth in claim 11, wherein:

said two groups of said four corner protector magazines comprises a first group of two corner protector magazines diagonally opposed with respect to each other at first and second corners within said substantially rectangular array, and a second group of two corner protector magazines diagonally opposed with respect to each other at third and fourth corners within said substantially rectangular array; and said two groups of said four corner protector pick-up arm and transfer assemblies comprises a first group of two corner protector pick-up arm and transfer assemblies diagonally opposed with respect to each other at said first and second corners within said substantially rectangular array, and a second group of two corner protector pick-up arm and transfer assemblies diagonally opposed with respect to each other at said third and fourth corners within said substantially rectangular array.

13. The apparatus as set forth in claim 12, further comprising:

sensor means for determining the height dimension of the load to be wrapped at said single wrapping station, and for generating a signal indicative of the sensed height dimension of the load to be wrapped at said single wrapping station; and means for receiving said sensor signal and for selectively activating a single one of said first and second groups of said corner protector magazines and a single one of said first and second groups of said corner protector pick-up arm and transfer assemblies such that appropriately sized corner protectors are deposited upon corner regions of the loads.

14. The apparatus as set forth in claim 13, further comprising:

turntable means disposed at said single wrapping station for positioning the load between a first angular position at which two corner protectors are mounted upon two corners of the load by said single one of said first and second groups of said corner protector pick-up arm and transfer assemblies, and a second angular position, displaced 90° from said first angular position, at which two additional corner protectors are mounted upon two other corners of the load by said single one of said first and second groups of said corner protector pick-up arm and transfer assemblies.

15. The apparatus as set forth in claim 13, further comprising:

infeed and outfeed conveyor means for conveying a load to be wrapped toward said single wrapping station, and for conveying a wrapped load away from said single wrapping station.

16. The apparatus as set forth in claim 15, wherein:

said sensor means comprises photodetector means disposed upon opposite sides of said infeed conveyor means.

17. A method of placing corner protectors upon corner regions of a load to be wrapped, comprising the steps of:

providing a single wrapping station for supporting loads to be wrapped;

dividing a plurality of corner protector magazines into two groups of corner protector magazines and respectively depositing corner protectors having two different height dimensions, for placement upon corner regions of loads supported upon said single wrapping station, within said two groups of corner protector magazines;

dividing a plurality of corner protector pick-up arm and transfer assemblies, respectively operatively associated with said two groups of said corner protector magazines, into two groups of corner protector pick-up arm and transfer assemblies; and selectively activating a first one of said two groups of said corner protector pick-up arm and transfer assemblies so as to pick up and transfer corner protectors, having a first height dimension, from a first one of said two groups of said corner protector magazines so as to place said corner protectors, having said first height dimension, upon corner regions of a first load supported upon said single wrapping station and requiring corner protectors having said first height dimension, while a second one of said two groups of said corner protector pick-up arm and transfer assembly means, operatively associated with a second one of said two groups of said corner protector magazines housing corner protectors having a second height dimension, remains idle, and alternatively selectively activating a second one of said two groups of said corner protector pick-up arm and transfer assemblies so as to pick up and transfer corner protectors, having a second height dimension, from said second one of said two groups of said corner protector magazines so as to place said corner protectors, having said second height dimension, upon corner regions of a second load supported upon said single wrapping station and requiring corner protectors having said second height dimension, while said first one of said two groups of said corner protector pick-up arm and transfer assemblies, operatively associated with said first one of said two groups of said corner protector magazines housing corner protectors having said first height dimension, remains idle.

18. The method as set forth in claim 17, further comprising the step of:

arranging said plurality of corner protector magazines, and said plurality of corner protector pick-up arm and transfer assemblies respectively operatively associated with said plurality of corner protector magazines, in a substantially rectangular array around said single wrapping station.

19. The method as set forth in claim 18, wherein:

said plurality of corner protector magazines, and said plurality of corner protector pick-up arm and transfer assemblies respectively operatively associated with said plurality of corner protector magazines, disposed in said substantially rectangular array comprise four corner protector magazines and four corner protector pick-up arm and transfer assemblies for disposition adjacent to the corner regions of the loads supported upon said single wrapping station.

20. The method as set forth in claim 19, wherein:

said two groups of said four corner protector magazines comprises a first group of two corner protector magazines diagonally opposed with respect to each other at first and second corners within said substantially rectangular array, and a second group of two corner protector magazines diagonally opposed with respect to each other at third and fourth corners within said substantially rectangular array; and said two groups of said four corner protector pick-up arm and transfer assemblies comprises a first group of two corner protector pick-up arm and transfer assemblies diagonally opposed with respect to each other at said first and second corners within said substantially rectangular array, and a second group of two corner protector pick-up arm and transfer assemblies diagonally opposed with respect to each other at said third and fourth corners within said substantially rectangular array.

21. The method as set forth in claim 20, further comprising the steps of:

sensing the height dimension of the load to be wrapped at said single wrapping station, and generating a signal indicative of the sensed height dimension of the load to be wrapped at said single wrapping station; and selectively activating a single one of said first and second groups of said corner protector magazines and a single one of said first and second groups of said corner protector pick-up arm and transfer assemblies such that appropriately sized corner protectors are deposited upon corner regions of the loads.

22. The method as set forth in claim 21, further comprising the steps of:

providing a turntable at said single wrapping station; and selectively rotating said turntable so as to position the load at a first angular position at which two corner protectors are mounted upon two corners of the load by said single one of said first and second groups of said corner protector pick-up arm and transfer assemblies, and at a second angular position, displaced 90° from said first angular position, at which two additional corner protectors are mounted upon two other corners of the load by said single one of said first and second groups of said corner protector pick-up arm and transfer assemblies.

* * * * *